US006351058B1

(12) United States Patent
Roberts

(10) Patent No.: US 6,351,058 B1
(45) Date of Patent: Feb. 26, 2002

(54) XENON CERAMIC LAMP WITH INTEGRATED COMPOUND REFLECTORS

(75) Inventor: Roy D. Roberts, Hayward, CA (US)

(73) Assignee: EG&G ILC Technology, Inc., Sunnyvale, CA (US)

( * ) Notice: Subject to any disclaimer, the term of this patent is extended or adjusted under 35 U.S.C. 154(b) by 0 days.

(21) Appl. No.: 09/351,272

(22) Filed: Jul. 12, 1999

(51) Int. Cl.[7] ..... H01J 5/16

(52) U.S. Cl. ..... 313/113; 313/114; 362/263; 362/302; 362/310

(58) Field of Search ..... 313/113, 114, 313/634; 362/261, 263, 302, 304, 346, 343, 310

(56) References Cited

U.S. PATENT DOCUMENTS 4,305,099 A 12/1981 True et al. ..... 358/231
5,418,420 A * 5/1995 Roberts ..... 313/114
5,721,465 A 2/1998 Roberts ..... 313/46
5,869,920 A * 2/1999 Kvanagh ..... 313/113
6,120,166 A * 9/2000 Price ..... 362/302
6,200,005 B1 * 3/2001 Roberts et al. ..... 362/263

* cited by examiner

*Primary Examiner*—Ashok Patel
*Assistant Examiner*—Ken A Berck
(74) *Attorney, Agent, or Firm*—Thomas E. Schatzel; Law Offices of Thomas E. Schatzel

(57) ABSTRACT

An integrated compound reflector ceramic arc lamp comprises three internal mirrors. Top and bottom concave mirrors encircle the inter-electrode gap. The third mirror is convex and is mounted coaxially on the stem of the cathode and faces a sapphire window. Its appearance is like that of a 360 ° apron. Light rays emitted from the inter-electrode gap below a critical elevation angle will be reflected off the bottom concave mirror. Such rays bounce only once before exiting through the window to an external focus. Light rays emitted from the inter-electrode gap above the critical elevation angle, will be reflected off the top concave mirror. Such rays will bounce twice before exiting through the window to the focus. The rays that do reflect from the top concave mirror are directed to the convex cathode apron reflector, and from there will be reflected out the window to the focus.

4 Claims, 1 Drawing Sheet

XENON CERAMIC LAMP WITH INTEGRATED COMPOUND REFLECTORS

BACKGROUND OF THE INVENTION

1. Field of the Invention

Figure 1:
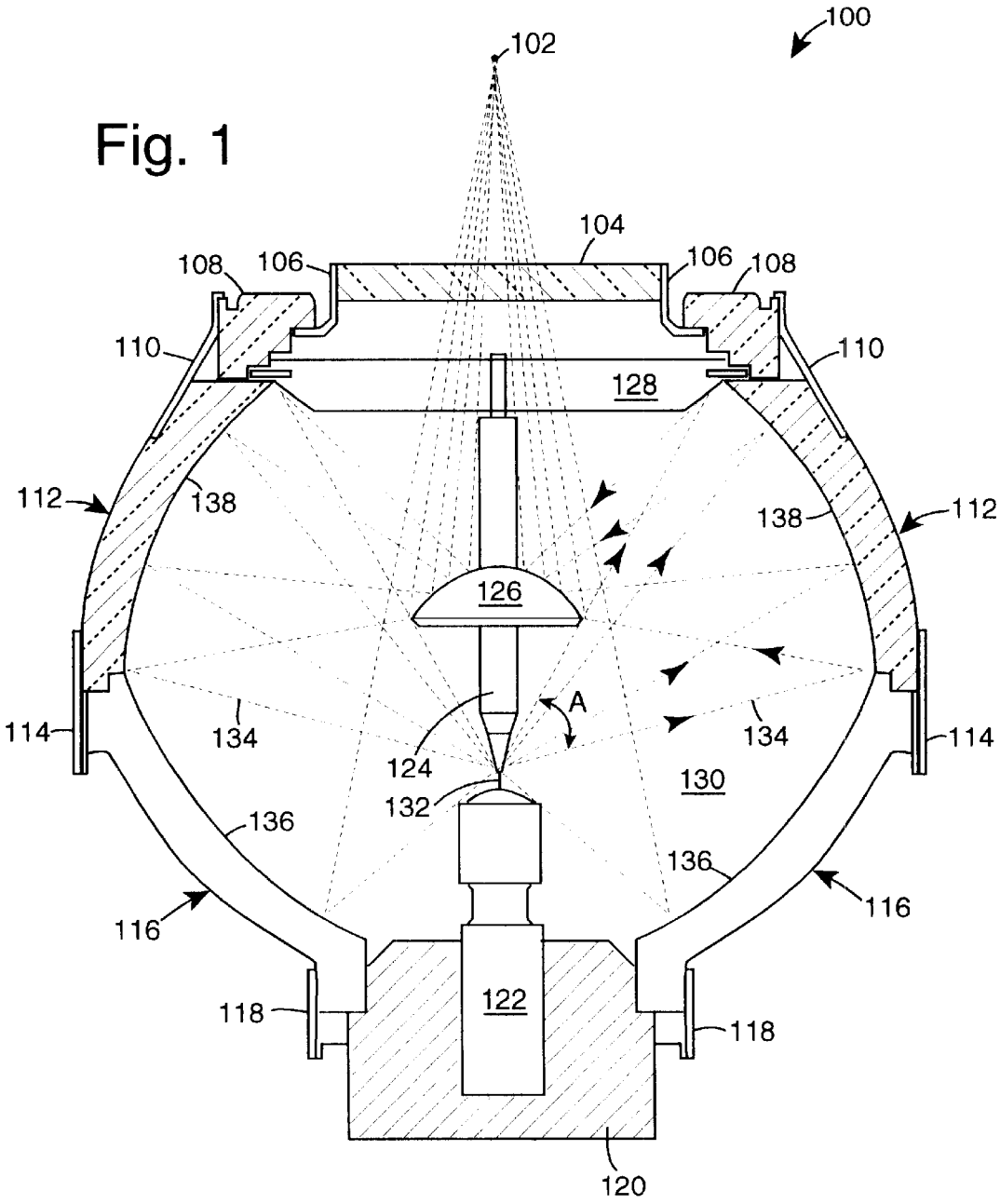

The invention relates generally to xenon short-arc ceramic lamps and specifically to such lamps which incorporate a spherical-elliptical reflector combination in a compound system to improve efficiency.

2. Description of the Prior Art

Short arc lamps provide intense point sources of light that allow light collection in reflectors for applications in medical endoscopes, instrumentation and video projection. Also, short arc lamps are used in industrial endoscopes, for example in the inspection of jet engine interiors. More recent applications have been in color television receiver projection systems.

A typical short arc lamp comprises an anode and a sharp-tipped cathode positioned along the longitudinal axis of a cylindrical, sealed concave chamber that contains xenon gas pressurized to several atmospheres. U.S. Pat. No. 5,721,465, issued Feb. 24, 1998, to Roy D. Roberts, describes such a typical short-arc lamp. A typical xenon arc lamp, such as the CERMAX marketed by ILC Technology (Sunnyvale, Calif.) has a three-legged strut system that holds the cathode electrode concentric to the lamp's axis and in opposition to the anode.

U.S. Pat. No. 4,305,099, describes a light collection system for projectors, such as light valve projectors, which have a compound reflector associated with an arc lamp. The compound reflector includes an ellipsoidal reflector positioned to collect a portion of the light from the arc lamp and reflect a direct image of the light in a beam to an image forming plane of the projector and a spherical reflector positioned to collect another portion of the light from the arc lamp and reflect it back through the gap of the arc lamp to the ellipsoidal reflector to be reflected as a secondary image of the light from the lamp in the beam. The ellipsoidal and spherical reflectors are formed as full, uninterrupted surfaces of revolution. To provide uniform light distribution, the beam is directed through a pair of spaced lens plates, each having corresponding arrays, in rows and columns, of rectangular lenticules. The adjacent focus of the ellipsoidal reflector is centered in the arc, while the center of curvature of the spherical reflector, in order to avoid transmission loss through the arc, is displaced to a portion of the gap of the lamp which is relatively free of the arc. For maximum light efficiency, the direct image is focused just to one side, and the secondary image is focused just to the other side of the image forming plane. Such patents are all incorporated herein by reference.

Conventional lamps with parabolic collector/reflectors have the advantage of good collection and distribution efficiency when used in conjunction with a lens for focusing. However, such combinations can be too expensive for many applications. Conventional lamps with elliptical collector/reflectors have a different kind of problem. In order to collect a large polar angle of the lamp output, a wide spread of arc magnifications are automatically generated at the second focus. The rays with the smallest angles have the largest magnification. And the rays with the largest angles have the smallest magnification.

The collection efficiency of conventional elliptical collector/reflectors is good, but the distribution efficiency is often poor. In a compound reflector geometry that combines reflector types, the elliptical part is usually a rather shallow dish that provides a small spread of arc magnifications over a select spread of ray angles. But the polar angle collection of such a lamp's output is rather poor from the sphere.

SUMMARY OF THE PRESENT INVENTION

It is therefore an object of the present invention to provide a xenon ceramic lamp that is more efficient than conventional designs.

Briefly, an integrated compound reflector ceramic arc lamp embodiment of the present invention comprises three internal mirrors. Top and bottom concave mirrors encircle the inter-electrode gap. The third mirror is convex and is mounted coaxially on the stem of the cathode and faces a sapphire window. Its appearance is like that of a 360° apron. Light rays emitted from the inter-electrode gap below a critical elevation angle will be reflected off the bottom concave mirror. Such rays bounce only once before exiting through the window to an external focus. Light rays emitted from the inter-electrode gap above the critical elevation angle, will be reflected off the top concave mirror. Such rays will bounce twice before exiting through the window to the focus. The rays that do reflect from the top concave mirror are directed to the convex cathode apron reflector, and from there will be reflected out the window to the focus.

An advantage of the present invention is that a ceramic lamp is provided in which the lamp collection angle is increased over the prior art.

Another advantage of the present invention is that a ceramic lamp is provided which is more efficient than the quartz lamps or other types of separate envelopes and compound reflectors.

A further advantage of the present invention is that a lamp is provided in which three mirror surfaces can be manipulated to control lumen delivery to an aperture, e.g., a light pipe for a projection television system.

A still further advantage of the present invention is that a lamp is provided in which reflected light is not depended upon to pass through the arc or near the arc, because such arc can actually block the passage.

These and other objects and advantages of the present invention will no doubt become obvious to those of ordinary skill in the art after having read the following detailed description of the preferred embodiment which is illustrated in the drawing figure.

IN THE DRAWINGS

FIG. 1 is a cross-sectional diagram of an integrated compound reflector ceramic arc lamp embodiment of the present invention.

DETAILED DESCRIPTION OF THE PREFERRED EMBODIMENT

FIG. 1 represents an integrated compound reflector ceramic arc lamp embodiment of the present invention, referred to herein by the general reference numeral 100. The lamp 100 has an external focus 102 and comprises a sapphire window 104 fitted with a metal ring 106 to a ceramic cap ring 108. A metal cone 110 seals the window and ring assemblies 104–108 to a ceramic body 112. A metal waistband 114 seals the upper assemblies to a metal body 116. A base ring 118 is used to seal the bodies 112 and 116 to a copper base 120. A tungsten anode 122 is opposite to a tungsten cathode 124.

A convex cathode apron reflector 126 is positioned at a critical point on the stem of cathode 124. In a typical application, the top surface of the convex cathode apron reflector 126 is spherical. Distorted contours may be used for special output patterns of light, e.g., square rather than round.

A conventional strut system 128 suspends the cathode 124 above the anode 122. A xenon atmosphere 130 is contained inside, as is conventional.

Light rays emitted from an inter-electrode gap 132 below the angle of a ray 134, e.g., more toward the base 120, will be reflected off a mirror 136 on the inside concave surface of the metal body 116. Such rays bounce only once before exiting through window 104 to focus 102. Such mirror 136 may be elliptical.

Light rays emitted from the inter-electrode gap 132 above the angle of ray 134, e.g., more toward the cathode 124, will be reflected off a mirror 138 on the inside concave surface of the ceramic body 112. Such rays will bounce twice before exiting through window 104 to focus 102. The rays that reflect from mirror 138 are directed to the convex cathode apron reflector 126, and from there will be reflected out the window 104 to focus 102. Such mirror 138 may also be elliptical.

In a typical embodiment of the present invention, the sapphire window 104 has a two inch diameter, waistband 114 is 5.218 inches in diameter, and the distance from the front of window 104 to the bottom of the base 120 is about 5.403 inches. The solid collection angle which is reflected by mirrors 136 and 138, relative to the inter-electrode gap 132 is about 100° of elevation span. Such angle is labeled "A" in FIG. 1. Given such, the lamp 100 is operable at power levels on the order of 2,000 to 3,000 watts.

Embodiments of the present invention have magnification reduced by over fifty percent and the collection solid angle is thirty-three percent better, compared to the EX3000 marketed by ILC Technology, Inc. (Sunnyvale, Calif.). The ceramic nearest the anode is set away farther, and this is expected to reduce thermal stresses in the ceramic. Preferably, such embodiments are implemented to fit existing lamp holder designs, and use a standard two inch diameter sapphire window. Preferred embodiments of the present invention also have uniform ceramic wall thicknesses, e.g., in ceramic body 112. Such uniformity further reduces thermal stresses that can develop which will shorten lamp life. A lamp such as lamp 100 in FIG. 1 should be readily implementable in a 2,000 to 3,000 watt version, and would be especially useful in video projection systems.

Alternative embodiments of the present invention include a quartz bubble lamp.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. An improved xenon arc lamp with a cathode and anode electrode in a xenon atmosphere, the improvements comprising:

an envelope comprising a bowled lower metal body joined at its outer circumference to an oppositely bowled upper ceramic body at its outer circumference, and a sapphire window disposed in the middle of the ceramic body, and all symmetrically disposed around a central lamp axis;

a lower concave mirror fully included in the lower metal body and coaxially disposed around an anode electrode and facing toward a window;

an upper concave mirror fully included in the upper ceramic body and coaxially disposed around a cathode electrode and facing both the lower concave mirror and an inter-electrode gap;

a convex apron mirror coaxially mounted on a stem of said cathode electrode between said inter-electrode gap and any cathode stem support, and facing said sapphire window away from said inter-electrode gap; and an interface between the upper and lower concave mirrors and which is disposed at a constant elevation angle relative to said inter-electrode gap;

wherein, light rays emitted from said inter-electrode gap below said constant elevation angle will be reflected only off the lower concave mirror before exiting through said window to an external focus; and wherein, all light rays emitted from said inter-electrode gap above said constant elevation angle and that are emitted out said window to said focus are reflected only by the upper concave mirror to only the convex apron mirror.

2. The lamp of claim 1, wherein:

the upper ceramic body has a uniform ceramic wall thickness;

wherein said uniformity reduces thermal stresses that can otherwise shorten lamp life.

3. The lamp of claim 1, wherein:

the upper and lower concave mirror, the convex apron mirror, and the dimensions of said cathode electrode are such that a collection solid angle for the lamp is not less than 100°.

4. The lamp of claim 2, wherein:

said ceramic body is constructed and disposed to allow the lamp to operate at power levels on the order of 2,000 to 3,000 watts.

* * * * *